United States Patent [19]

Roberts

[11] Patent Number: 4,967,037

[45] Date of Patent: Oct. 30, 1990

[54] DRIVING CIRCUIT FOR A CAPACITOR DISCHARGE IGNITION SYSTEM

[75] Inventor: William J. Roberts, Toledo, Ohio

[73] Assignee: Prestolite Electric Incorporated, Toledo, Ohio

[21] Appl. No.: 380,138

[22] Filed: Jul. 14, 1989

[51] Int. Cl.[5] ..... F02P 3/06

[52] U.S. Cl. ..... 123/598

[58] Field of Search ..... 123/598, 634, 637, 606, 123/597

[56] References Cited

U.S. PATENT DOCUMENTS

| | | | |
|---|---|---|---|
| 4,004,561 | 1/1977 | Thieme | 123/598 |
| 4,014,308 | 3/1977 | Schweitzer | 123/598 |
| 4,033,316 | 7/1977 | Birchenough | 123/598 |
| 4,069,801 | 1/1978 | Stevens | 123/598 |
| 4,097,770 | 6/1978 | Fisher | 123/598 |
| 4,677,960 | 7/1987 | Ward | 123/598 |
| 4,841,925 | 6/1989 | Ward | 123/598 |

*Primary Examiner*—Raymond A. Nelli

*Attorney, Agent, or Firm*—McAndrews, Held & Malloy, Ltd.

[57] ABSTRACT

A capacitor-discharge ignition system discharges a load capacitor to drive an ignition coil for producing an ignition spark. The ignition system includes an oscillator generating complimentary pulse trains that activate a pair of power FETs to drive a transformer. The transformer generates an output voltage that is doubled in magnitude and stored in the load capacitor until the load capacitor is triggered by a trigger circuit to provide an ignition spark. A signal generated by a feedback circuit in response to the occurrence of an ignition spark is employed to inhibit further discharge of the load capacitor as well as to deactivate the transformer. An auxiliary D.C.-to-D.C. converter driven by the oscillator provides a supply voltage for the components of the ignition system.

20 Claims, 3 Drawing Sheets

SPARK PLUG
SPARK SENSOR
INHIBITOR
IGNITION COIL
LOAD CAPACITOR
VOLTAGE DOUBLER
STEP-UP TRANSFORMER
GATE
GATE
OSCILLATOR
VOLTAGE REGULATOR
BATTERY
GATE
TRIGGER UNIT
AUXILIARY DC—DC CONVERTER
+ 5V
+ 15V
10
12
14
16
18
20
22
24
26
28
30
32
34
36
38
40
41
42
44
46
48
50
52
76
78
80
82

DRIVING CIRCUIT FOR A CAPACITOR DISCHARGE IGNITION SYSTEM

FIELD OF INVENTION

The present invention relates to a capacitor-discharge ignition system and more particularly to the drive circuits for the ignition coil of such a system.

DESCRIPTION OF THE BACKGROUND

Capacitor-discharge ignition systems are known for driving the ignition coil of an internal-combustion engine. Such capacitor-discharge ignition systems have included a constant frequency oscillator driving a single power FET which, in response to the oscillator, applies an input voltage across a single primary winding of a step-up transformer to charge a load capacitor for driving an ignition coil.

Although such capacitor-discharge ignition systems adequately drive an ignition coil, the use of a transformer having a single primary winding that receives an input voltage in response to the switching of a single power FET requires that the primary have a large number of turns for storing energy in the form of inductance which is utilized during the off-times of the power FET. To store a sufficient amount of energy in the transformer, an input current having a large peak amplitude must be provided through the primary of the transformer during the periods when the power FET is activated. The large peak input current in the primary tends to generate noise which necessitates the use of costly electrolytic filtering capacitors that will not succumb to the high ambient temperatures associated with internal combustion engines.

SUMMARY OF THE INVENTION

In accordance with the present invention, the disadvantages of capacitor-discharge ignition systems as discussed above have been overcome. The system of the present invention operates with a low peak input current so that the noise associated with the input current is reduced, eliminating the need for costly electrolytic filter capacitors. The system of the present invention is thus more efficient, less costly and can operate at higher allowable ambient temperatures.

The system of the present invention includes an ignition coil driven by the discharge of a load capacitor. A transformer is provided having a center tapped primary winding and a secondary winding that is coupled to the load capacitor for charging the load capacitor. The primary winding of the transformer is driven by complimentary square waves, the frequency of which varies linearly with the voltage of the battery powering the system so as to provide an input current to the primary that has a substantially constant peak amplitude despite variations in the battery voltage. The system of the present invention therefore can operate over a five-to-one range of voltages to avoid problems with transformer saturation and to avoid excessive current in the power semiconductors.

The system further includes a circuit for doubling the voltage produced by the transformer so as to double the magnitude of the voltage stored by the load capacitor.

In addition, the secondary winding of the transformer floats, i.e. it is not connected directly to ground so that there is no direct current path from the load capacitor to the spark electrode.

A feedback circuit is further provided, the circuit being responsive to the occurrence of an ignition spark produced by driving the ignition coil in response to the discharge of the load capacitor for preventing further discharge of the load capacitor so as to conserve the charge thereon and to delay subsequent recharging of the load capacitor to reduce inrush currents.

BRIEF DESCRIPTION OF THE DRAWINGS

Other features and advantages of the invention will be apparent from the following description taken in connection with the accompanying drawings wherein.

DETAILED DESCRIPTION OF THE PREFERRED EMBODIMENT

Figure 1:
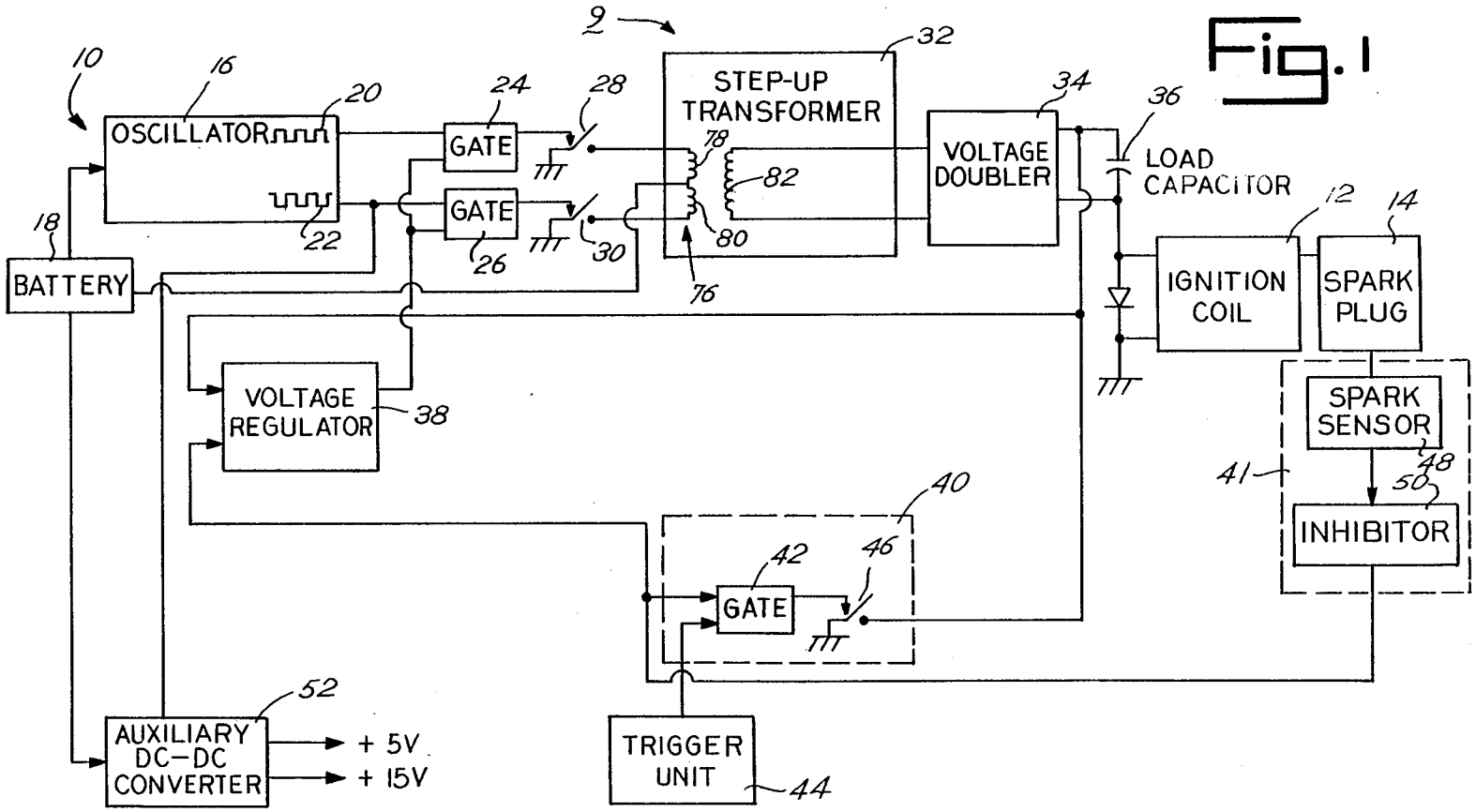
FIG. 1 is a block diagram of the ignition circuit of the present invention.

A capacitor-discharge ignition circuit 9 for an internal-combustion engine as shown in FIG. 1 includes a driver circuit 10 which generates a voltage at a suitable level to drive an ignition coil 12 for producing an ignition spark at a spark plug 14. The driver circuit includes a center-tapped, step-up transformer 32 that is responsive to a pair of complimentary pulse trains 20 and 22 generated by an oscillator 16 for producing an output voltage the magnitude of which is doubled by a voltage doubler 34 and stored in a load capacitor 36.

The oscillator 16 is powered by a battery 18 for generating the complimentary pulse trains 20 and 22, the frequencies of which vary linearly with the voltage of battery 18. The complimentary pulse trains are passed through a pair of gates 24 and 26 to alternately activate a pair of switches 28 and 30 which, upon being activated, cause current to flow to ground alternatively through a primary winding 76 that includes a first primary winding 78 and a second primary winding 80 of the transformer 32. Because the frequency of the pulse trains 20 and 22 varies linearly with the voltage of the battery 18, the current flowing alternatively through the first and second primary windings 78 and 80 of the transformer 32 has a constant peak amplitude. The constant peak current driving transformer 32 enables the transformer 32 to remain operative as the battery voltage is drained. The driver circuit 10 is thus capable of operating over a five-to-one range of battery voltages, namely +25V to +5 V, so as to avoid problems of saturation of the transformer 32 due to excessive drive current as well as avoiding excessive current in the power semiconductors. Further, the center-tap configuration of the transformer's primary winding 76 that permits current to flow in opposite directions through the first and second primary windings 78 and 80 allows the minimum amplitude of current required to drive the transformer 32 to be reduced. The overall efficiency of the driver circuit 10 is thus improved while reducing the amount of noise associated with high-level input current peaks.

The transformer 32 is a step-up transformer so that the output voltage at a secondary winding 82 of the transformer is greater than the battery voltage at the primary winding 76 of the transformer by an amount dependant upon the turns ratio of the transformer. The output voltage at the secondary winding 82 of the transformer 32 is further increased by a voltage doubler 34 which serves to double the magnitude of the transformer output voltage. The doubled voltage produced by the voltage doubler 34 is stored by a load capacitor 36 until needed to drive the ignition coil 12. The voltage doubler 34 allows a smaller, less costly step-up transformer 32 to be employed. The voltage doubler 34 also serves to limit the amount of output current induced in the transformer 32 to prevent the induced output current from reaching an excessive level, a condition which, if present, could lead to transformer burn-up.

A voltage regulator 38 monitors the amount of voltage delivered from the voltage doubler 34 to the load capacitor 36 to maintain the load capacitor 36 at an appropriate voltage. Should the voltage delivered to the load capacitor exceed +250 volts, the voltage regulator 38 will develop a signal causing gates 24 and 26 to open the respective switches 28 and 30 thereby deactivating the transformer 32. The voltage in excess of +250 volts will then be bled off through the voltage regulator 38.

Referring again to FIG. 1, the ignition circuit 9 includes a trigger circuit 40 that triggers the discharge of the load capacitor 36 to drive the ignition coil 12. The trigger circuit 40 is responsive to the output of a trigger unit 44 that provides a trigger signal to control the time at which the load capacitor 36 discharges to produce an ignition spark in the spark plug 14. The trigger circuit 40 includes a gate 42 that is responsive to the trigger signal to close a switch 46. When the switch 46 is closed, the load capacitor 36 is grounded causing a negative voltage to be applied to the ignition coil 12. In response to the negative voltage, the ignition coil 12 develops a potential across the spark plug 14 that breaks down at some point to produce an ignition spark.

The ignition circuit 9 further includes a feedback circuit 41 that is provided to inhibit the operation of the step-up transformer 32 in response to the occurrence of an ignition spark at the spark plug 14. The feedback circuit 41 includes a spark sensor 48 which, upon detecting the initiation of an ignition spark occurring in the spark plug 14, generates a feedback signal that is applied to an inhibitor 50. The inhibitor 50 is responsive to the feedback signal for providing an inhibit signal that is applied to the trigger circuit 40. In response to the inhibit signal, the trigger circuit 40 opens the switch 46 via the gate 42 to prevent further discharge of the load capacitor 36 for a period of approximately 40 microseconds following the initiation of the ignition spark. Inhibiting the discharge of the load capacitor 36 shortly after the generation of an ignition spark conserves the charge available on the load capacitor and allows multiple ignition sparks to be provided. In addition to inhibiting the discharge of the load capacitor 36, the inhibit signal produced by the inhibitor 50 is passed to the gates 24 and 26 via the voltage regulator 38 in order to open the associated switches 28 and 30 for a period of approximately 40 microseconds following the initiation of the ignition spark. It has been found that by deactivating step-up transformer 32 inrush currents are minimized.

The ignition circuit 9 of FIG. 1, further includes an auxiliary D.C.-to-D.C. converter 52 for providing +5 volt and +15 volt supply voltages to the components of the ignition circuit 9. Because an auxiliary D.C.-to-D.C. converter 52 powers the components rather than the transformer 32, it is ensured that the full voltage required by the components is available during the initiation of an ignition cycle that starts the associated internal combustion engine.

Figure 2:
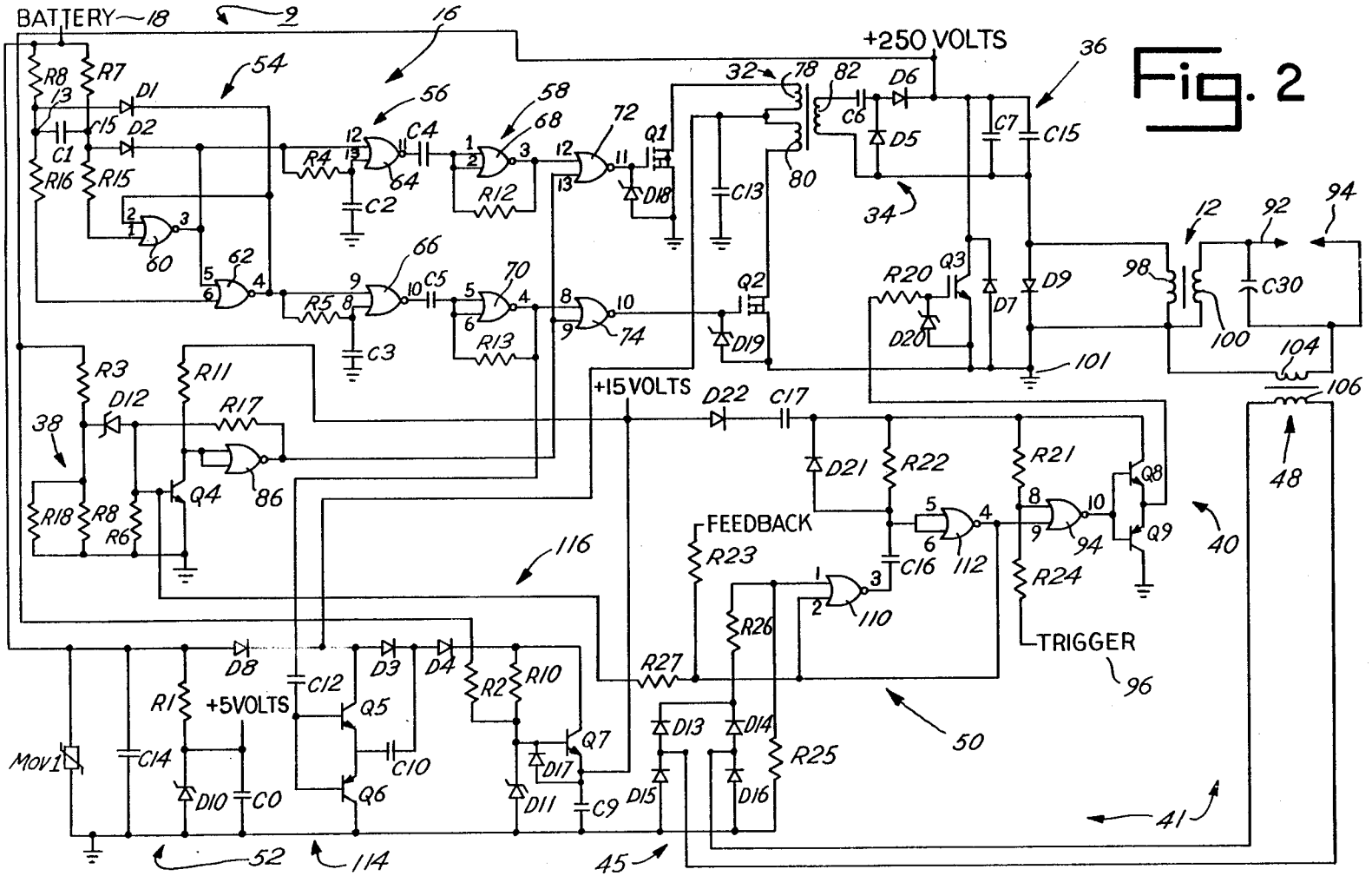
FIG. 2 is a schematic diagram of the ignition circuit of FIG. 1.

The ignition circuit 9 for an internal combustion engine is shown in greater detail in FIG. 2. The oscillator 16 includes a pulse train generator 54 that generates the pair of complementary pulse trains 20 and 22 (FIG. 1) having rising edges that are delayed by a delayed stage 56 and which are level-shifted by a biasing stage 58 for driving a pair of power FETs Q1 and Q2. The pulse train generator 54 comprises a 0.0022 uF capacitor C1 which is coupled to a pair of NOR gates 60 and 62 configured in a flip-flop arrangement to provide the complimentary pulse trains 20 and 22. The 0.0022 uF capacitor C1 is coupled to battery 18 through a pair of 22 kΩ resistors R7 and R8 that are respectively connected to the capacitor C1 at nodes 15 and 13. The NOR gate 60 includes an input pin 1 coupled to the node 15 through a current limiting 1MΩ resistor R15 and the NOR gate 62 includes an input pin 6 coupled to the node 13 through a current limiting 1MΩ resistor R16. The input pin 2 of the NOR gate 60 is connected to the output pin 4 of the NOR gate 62 while the input pin 5 of the NOR gate 62 is connected to the output pin 3 of the NOR gate 60 thereby forming the flip-flop configuration mentioned above. The output of the NOR gate 60 is additionally coupled to the node 15 through a diode D2 while the output of the NOR gate 62 is coupled to the node 13 through a diode D1. The diodes D1 and D2 serve to alternately pull-down the voltage across the resistors R7 and R8 to pull alternate sides of the capacitor C1 low. This permits the capacitor C1 to charge on alternate sides so as to provide the complementary pulse trains 20 and 22 at the outputs of the NOR gates 60 and 62.

The frequency of each of the pulse trains generated by the generator 54 is related to the rate at which the capacitor C1 alternately charges. As the magnitude of the voltage supplied by the battery 18 decreases due to the operation of the ignition circuit 9 over time, the period required to alternately charge the capacitor C1 will increase thereby decreasing the frequency of the pulse trains so that the frequency of the pulse trains varies linearly with the voltage supplied by the battery 18.

The complimentary pulse trains 20 and 22 generated at the output of the NOR gates 60 and 62 are applied to the respective power FETs Q1 and Q2 through the delay stage 56 and the bias stage 58 for applying the voltage of the battery 18 to switch current alternatively through the first primary winding 78 and the second primary winding 80 of the center-tapped transformer 32 wherein the switching frequency varies linearly with the voltage of the battery 18 so as to produce a current flowing alternatively through the first and second primary windings 78 and 80 of the transformer 32 that has a constant peak amplitude for the +25 volt to +5 volt range of the voltages supplied by the battery 18.

The delay stage 56 comprises a pair of NOR gates 64 and 66 each having an RC network associated with its input for delaying the rising edges of the incoming pulse train generated by the pulse train generator 54. The RC network associated with the NOR gate 64 includes a 2.2 kΩ resistor R4 connected to ground through a 0.001 uF capacitor C2, the resistor R4 also being connected across the input pins 12 and 13 of the NOR gate 64. In response to a falling edge of the incoming pulse train, the capacitor C2 momentarily holds the pin 13 high thereby momentarily holding the output of the NOR gate 64 low to delay the rising edge of the pulse train appearing at the output of the NOR gate 64. In a similar manner, a 2.2 kΩ resistor R5 and 0.001 uF capacitor C3 are connected to the NOR gate 66 for delaying the rising edge of the pulse train appearing at the output of the NOR gate 66. The pulse trains appearing at the outputs of the NOR gates 64 and 66 are "substantially" complimentary in the sense that the rising edges of each pulse train have been delayed only slightly to ensure that the power FETs Q1 and Q2 are not on at the same time since activating the power FETs Q1 and Q2 simultaneously could produce a damaging current spike in the transformer 32.

Each pulse train output by the delay stage 56 is applied to the biasing stage 58 through a respective .01 uF capacitor C4 and C5 that couples the pulse train to the biasing stage without effecting the D.C. bias of the pulse train. The biasing stage 58 includes a pair of NOR gates 68 and 70 the inputs of which are connected to the respective capacitor C4 and C5 and each having a respective 47 kΩ resistor R12 and R13 in a feedback path to keep the input of the respective NOR gate at a gate threshold for elevating the D.C. bias of each of the pulse trains. Elevating the D.C. bias of the pulse trains ensures that the pulse trains are sufficiently capable of driving the power FETs Q1 and Q2. The delayed, level-shifted pulse train appearing at the output of each of the NOR gates 68 and 70 is applied to an input pin 13 and 8 of a respective NOR gate 72 and 74. The NOR gates 72 and 74 will pass the pulse trains to the gates of the power FETs Q1 and Q2 unless inhibited by a signal appearing on respective input pins 12 and 9 as described hereinafter.

The power FETs Q1 and Q2, in response to the complimentary pulse trains from the oscillator 16, alternately conduct to draw current alternatively through the first and second primary windings 78 and 80. Each of the power FETs Q1 and Q2 includes a zener diode D18 and D19 connecting the power FET's source to its gate to prevent the power FET from being driven beyond its ratings.

The first primary winding 78 and the second primary winding 80 of the transformer 32 each have 64 turns, the secondary winding 82 of the transformer 32 has 2000 turns. The first winding 78 connects the battery 18 to ground through the power FET Q1. Thus, when the power FET Q1 is conducting, current will flow through the first primary winding 78. Similarly, the second primary winding 80 connects the battery 18 to ground through the power FET Q2 so that when the power FET Q2 is conducting, current will flow through the second primary winding 80 in a direction opposite to the current flowing through the first primary winding 78. A 10 uF filter capacitor C13 connects the first and second primary windings 78 and 80 to ground for bypassing disturbances in the battery voltage due to the switching of the poWer FETs Q1 and Q2. Bypassing disturbances in the battery voltage provides a cleaner line voltage.

Because the frequency of the pulse trains driving the power FETs Q1 and Q2 varies linearly with the battery voltage, the current flowing alternatively through the first and second primary windings 78 and 80 has a constant peak amplitude. Varying the transformer drive frequency linearly with the battery voltage in this manner produces a constant peak flux in the transformer 32 where flux is the integral of volts per turn over time. Because the peak amplitude of the input current in the transformer 32 remains constant, the transformer is capable of operating over a 5 to 1 range of battery voltages (+25 volts to +5 volts) to avoid transformer saturation which typically arises from an excessive current flow in the primary due to high input voltages. Excessive currents in the FETs Q1 and Q2 are also avoided.

Because the pulse trains driving the power FETs Q1 and Q2 are substantially complementary, current is always flowing in either a first direction through the first primary winding 78 or in a second direction, opposite the first direction, through the second primary winding 80. This configuration of the transformer 32 reduces the magnitude of the current required to drive the transformer 32 as compared to single primary winding transformers. Because the magnitude of the input current needed to drive the transformer 32 is low the drive circuit 10 is more efficient than prior known drive circuits as well as less costly, the need for expensive electrolytic filter capacitors having been eliminated.

The transformer 32 provides a voltage across the secondary winding 82 in response to the battery voltage applied across the first and second primary windings 78 and 80. Upon the activation of the power FET Q1, the battery voltage is applied to the lower end of the first primary winding 78 to induce a stepped-up output voltage across the secondary winding 82 having a first polarity. In a similar manner, the activation of the power FET Q2, applies the battery voltage to the upper end of the second primary winding 80 to induce a stepped-up output voltage across the secondary winding 82 having a polarity opposite the first polarity.

The voltage doubler 34 includes a pair of diodes D5 and D6 connected to a .001uF doubling capacitor C6 that is connected in series to the secondary winding 82 of the transformer 32. When the polarity of the output voltage across the secondary winding 82 is such that a positive pole appears at the lower end of the secondary winding 82, the diode D5 conducts to develop a voltage across the doubling capacitor C6. When the polarity of the output voltage across the secondary winding 82 reverses so that a positive pole appears at the upper end of the secondary winding 82, the output voltage is effectively placed in series with the voltage across the doubling capacitor C6 thereby doubling the magnitude of the output voltage produced by the transformer 32. In turn, the doubled output voltage is passed through the diode D6 and stored as a potential across a pair of 6.8 uF load capacitors C7 and C15 connected in parallel across the voltage doubler 34. The diode D6 serves to prevent the leakage of charge stored in the load capacitors C7 and C15. It should be noted that the load capacitors C7 and C15 are connected in parallel to effectively form the single load capacitor 36 of FIG. 1. In addition to doubling the voltage across the secondary winding 82, the doubling capacitor C6 serves to limit the current flowing through the secondary winding 82 of the transformer 32. Limiting the current through the secondary winding 82 serves to prevent transformer burnup which typically occurs due to an excessive current flow through the secondary winding.

The turns ratio of the turns of the secondary winding 82 to the turns of the first or second primary winding 78 or 80 of the transformer 32 is 30.4:1. This ratio permits the transformer 32 to provide a full normal output voltage at the minimum input voltage supplied by the battery 18. The 2000 secondary winding turns is chosen to make the inductance associated with the secondary winding 82 relatively large. As a result, damaging resonances associated with the interaction between the inductance of the secondary winding 82 and the capacitance of the doubling capacitor C6 occur only at low battery voltages. This prevents a damagingly high voltage from being induced across the secondary winding 82. The output of the transformer 32 is above resonance, however, for most of the +25 volt to +5 volt range of battery voltages.

The parallel combination of the load capacitors C7 and C15 is charged, by the cooperative operation of the transformer 32 and the voltage doubler 34, to a potential of +250 volts. This potential is capable of sufficiently driving the ignition coil 12 connected to the anodes of the load capacitors C7 and C15. Should the potential exceed +250 volts, the voltage regulator 38 coupled to the load capacitors C7 and C15 will be activated to turn off the transformer 32 and bleed off any potential in excess of +250 volts.

The voltage regulator 38 includes a zener diode D12 coupled to the load capacitors C7 and C15 through a 470 kΩ resistor R3 which is coupled to ground through a calibration resistor R18 and a 33 kΩ resistor R8 connected in parallel. The zener diode D12 is connected to the base of a transistor Q4. In the event that the potential across the load capacitors C7 and C15 exceeds 250 volts, the zener diode D12 breaks down to conduct current through a 2.2kΩ resistor R6 for developing a potential across the resistor R6 which serves to turn on the transistor Q4. Upon being activated, the transistor Q4 momentarily grounds a +15 volt supply voltage passed across a 100 kΩ resistor R11 thereby grounding the inputs of a NOR gate 86 connected to the collector of the transistor Q4. The NOR gate 86, in response, generates a signal that is applied to the input pins 12 and 9 of the respective NOR gates 72 and 74. Upon receiving the signal, the NOR gates 72 and 74 prevent the complementary pulse trains generated by the oscillator 16 from being applied to the power FETs Q1 and Q2 thus deactivating the transformer 32 to prevent additional potential from being delivered to the load capacitors C7 and C15. The output of the NOR gate 86 is connected to the zener diode D12 and the base of the transistor Q4 through a 3.3MΩ resistor R17 for improving the switching capability of the transistor Q4. Any potential across the load capacitors C7 and C15 in excess of +250 volts is bled off through the resistors R3, R8, and R18.

The ignition circuit 9 additionally includes the trigger circuit 40 which triggers the discharge of the load capacitors C7 and C15 through an insulated gate bipolar transistor Q3 to produce a negative pulse applied to the ignition coil 12 which, in response, generates a potential across a pair of spark electrodes 92 and 94 of the type present in a typical spark plug. The insulated gate bipolar transistor Q3 couples the cathodes of the load capacitors C7 and C15 to ground. The base of the transistor Q3 is connected to the emitter-collector junction of a pair of transistors Q8 and Q9 through a 100Ω resistor R20. The trigger circuit further includes a NOR gate 94 having an input pin 9 connected to the feedback circuit 41 (FIG. 1) and an input pin 8 connected between a 100 kΩ resistor R21 and a 3.3 kΩ resistor R24 that are configured to serve as a voltage divider. The input pin 8 is normally held high by a +15 volt supply voltage passed across the resistors R21 and R24 until it is pulled low by a trigger signal 96 produced by the trigger unit 44 (FIG. 1). Should the input pin 9 of the NOR gate 94 be low when the trigger signal 96 is initiated, the NOR gate 94 will activate the transistors Q8 and Q9 to apply current to the base of the transistor Q3 thereby activating the transistor Q3. A zener diode D20 is connected to the base and the emitter of the transistor Q3 to prevent the transistor Q3 from being driven beyond its ratings. A fast recovery rectifying diode D7 connected across the transistor Q3 serves to protect the transistor Q3 from ringing caused by interaction between the capacitance of the load capacitors C7 and C15 and the inductance of the ignition coil 12.

Upon being activated, in response to the initiation of the trigger signal 96, the transistor Q3 grounds the load capacitors C7 and C15 thereby discharging the load capacitors to produce a negative pulse applied to a primary winding 98 of the ignition coil 12. In response, a stepped-up voltage is induced across a secondary winding 100 of the ignition coil to charge a high voltage capacitor C30. The charging of the capacitor C30 develops a potential across the spark electrodes 92 and 94 of the spark plug 14 (FIG. 1). Depending upon the fuel mixture and pressure present between the spark electrodes 92 and 94, the potential developing across the spark electrodes will break down at some point to produce an ignition spark.

The secondary winding 82 of transformer 32 floats, i.e. the secondary 82 is not directly coupled to ground. More particularly, the secondary winding 82 is coupled to ground through a parallel combination of a diode D9 and the primary winding 98 of the ignition coil 12. Because of this configuration, no D.C. path exists between the parallel combination of the load capacitors C7 and C15 and the spark electrode 92.

The ignition circuit 9 further includes the feedback circuit 41 having the spark sensor 48 that senses the breakdown of the potential across the spark electrodes 92 and 94 and the inhibitor circuit 50 that generates the signal to inhibit further discharge of the load capacitors C7 and C15 to conserve energy. The signal inhibiting the discharge of the load capacitors C7 and C15 also serves to deactivate the transformer 32. The spark sensor 48 includes a first winding 104 that couples the spark electrode 94 to the ignition circuit ground 101, the spark sensor 48 having a second winding 106 connected across a rectifier 45 comprised of 2 pairs of diodes D13, D15 and D14, D16 connected in parallel.

Figure 3:
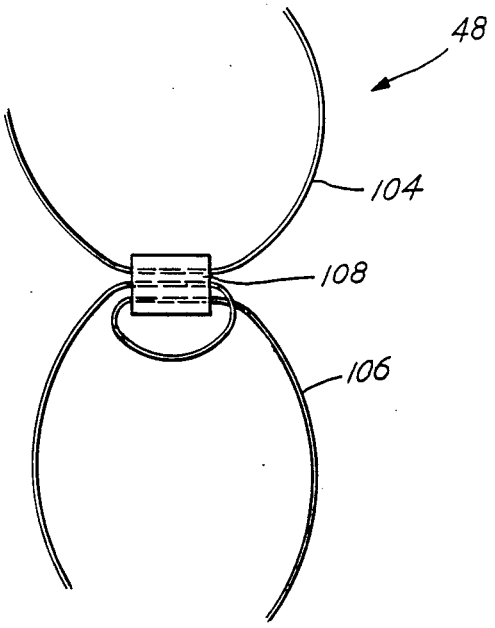
FIG. 3 is a schematic of the spark sensor of the present invention.

As shown in FIG. 3, the spark sensor 48 includes a ferrite bead 108 through which the first winding 104 passes once and through which the second winding 106 passes twice. Upon the occurrence of an ignition spark, high frequency RF noise flows through the first winding 104 thereby inducing a current through the second winding 106 which activates the inhibitor circuit 50.

The inhibitor circuit 50 includes a pair of NOR gates 110 and 112 coupled to the rectifier 45. The diode pairs D13,D15 and D14, D16 of the rectifier 45 rectify the current induced in the second winding 106 of the ignition coil 12 before the current is applied to a pair of 6.8 kΩ resistors R25 and R26 which are arranged in a voltage divider configuration. In response to the rectified current, the resistors R25 and R26 place a voltage on the input pin 1 of a NOR gate 110 thereby causing the NOR gate 110 to produce a signal which is coupled to the inputs of a NOR gate 112 through a 0.01 uF capacitor C16. The inputs of the NOR gate 112 are normally held high by the +15 volt supply voltage coupled to the inputs of the NOR gate 112 through a diode D7 and a 1.0uF coupling capacitor C17 in series with the parallel combination of a diode D21 and a 6.8 kΩ resistor R22 until the output of the NOR gate 110 pulls the inputs of the NOR gate 112 low. In response to the output of the NOR gate 110, the capacitor C16 holds the inputs of the NOR gate 112 low for a period of 40 microseconds thereby causing the output of the NOR gate 112 to go high for a period of 40 microseconds. The 40 microsecond output pulse appearing at the output of the NOR gate 112 is fed to the input pin 9 of the NOR gate 94 to override the trigger signal 96 and thus deactivate the transistor Q3 to inhibit further discharge of the load capacitors C7 and C15. The trigger signal 96 will be overridden to deactivate the transistor Q3 shortly after the initiation of an ignition spark. By deactivating the transistor Q3 shortly after the occurrence of an ignition spark, the charge remaining on the load capacitors C7 and C15 is conserved. Once deactivated, the transistor Q3 will remain deactivated for the duration of the 40 microsecond output pulse.

In addition to deactivating the transistor Q3, the 40 microsecond output pulse appearing at the output of the NOR gate 112 is fed back through a 15 kΩ resistor R27 to activate the transistor Q4. In a manner identical to that previously described, activating the transistor Q4 will enable the NOR gate 86 to produce a signal received by the NOR gates 72 and 74 which, in response, block the complimentary pulse trains driving the power FETs Q1 and Q2. As a result, the transformer 32 will be deactivated for the above mentioned 40 microsecond period. It has been found that this 40 microsecond period reduces inrush currents.

The ignition circuit 9 further includes the auxiliary D.C.-to-D.C. converter 52 comprising a +5 volt power supply 114 and a +15 volt power supply 116 to operate the components in the ignition circuit. The battery 18 supplying power to the +5 volt power supply 114 is coupled to ground through a 1.5 kΩ resistor R1 and a zener diode D10. The voltage across the resistor R1 is regulated by the zener diode D10 to provide a constant +5 volt output throughout the normal range of battery voltages. A 0.1 uF filter capacitor CO connected in parallel with the zener diode D10 provides a cleaner +5 volt output.

The +15 volt power supply 116 is driven by the output of the oscillator 16 to provide a constant +15 volt output throughout the normal range of voltages supplied by the battery 18, namely +25 volts to +5 volts. At the initiation of an ignition cycle that starts the internal-combustion engine associated with the ignition circuit 9, the oscillator 16 begins driving the +15 volt power supply 116 thereby enabling the power supply 116 to immediately provide a full +15 volt output at the initiation of the ignition cycle. The +15 volt power supply 116 includes a class-B amplifier comprising a PNP transistor Q5 and an NPN transistor Q6 which are coupled to the output of the NOR gate 70 through a 0.01 uF coupling capacitor C12. The level-shifted pulse train appearing at the output of the NOR gate 70 is applied via the coupling capacitor C12 to the base of each of the transistors Q5 and Q6 to alternately activate the transistors Q5 and Q6. A .1uF capacitor C10 is coupled to the battery 18 through a pair of diodes D8 and D3 as well as the transistor Q5 for amplifying the voltage supplied by the battery 18. When the transistor Q6 is activated, a current will flow through the diode D3 to develop a potential across the capacitor C10. Upon the activation of the transistor Q5, the potential across the capacitor C10 will effectively be placed in series with the voltage supplied by the battery 18 thereby amplifying the battery voltage. The amplified voltage is passed through a diode D4 and applied to the collector of a transistor Q7. In addition, the amplified voltage is coupled to the base of the transistor Q7 through a 33 kΩ resistor R10 for activating the transistor. Upon being activated, the transistor Q7 conducts to provide the +15 volt output. A zener diode D17 connects the base and the emitter of the transistor Q7 to prevent the transistor Q7 from being driven beyond its ratings. A 0.1 uF filter capacitor C9 provides a cleaner +15 volt output.

It should be noted that because the transistors Q5 and Q6 are driven by a pulse train the frequency of which varies linearly with the voltage supplied by the battery 18, the amplified voltage applied to the collector of the transistor Q7 may be greater than or equal to +15 volts all through the normal range of battery voltages, namely +25 volts to +5 volts. Should the amplified voltage placed at the collector of the transistor Q7 exceed +15 volts, a regulatory zener diode D11 coupled to the collector through the resistor R10 will break down to drain off the amplified voltage in excess of +15 volts. The load capacitors C7 and C15 are coupled to the base of the transistor Q7 through a 220 kΩ resistor R2 for keeping the transistor Q7 active when the voltage supplied by the battery 18 is in the lower end of its normal range.

In the event that the voltage supplied by the battery 18 suddenly increases to a possibly damaging level, a metal oxide varistor MOV1 will conduct to ground the voltage being supplied by the battery. A 1.0 uF filter capacitor C14 serves to filter the D.C. voltage supplied by the battery 18.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. In an ignition system having load capacitance means for charging and discharging to drive an ignition coil, an ignition coil drive system operable with low peak input currents comprising:

means for supplying power;

an oscillator coupled to said power supply means for generating first and second complimentary pulse train drive signals, the frequency of said drive signals varying directly with the magnitude of said supplied power;

a step-up transformer having a primary winding coupled to said oscillator and having a secondary winding providing a transformer output signal, said primary winding of said step-up transformer including a center tap coupled to said power supply means and connected between a first primary winding and a second primary winding;

means coupled between the secondary winding of said transformer and said load capacitance means for increasing by a factor the magnitude of said transformer output signal applied to said load capacitance means for charging said load capacitance means;

first means for switching between an open position and a closed position in response to said first pulse train; and second means for switching between an open position and a closed position in response to said second pulse train, said first primary winding of said transformer conducting current in a first direction when said first switch means is closed and said second primary winding conducting current in a second direction opposite said first direction when said second switch means is closed to induce current flowing in opposite directions in said secondary winding to charge said load capacitance means; and means for delaying the rising edge of each pulse of said pulse trains so that said pulse trains are substantially complimentary.

2. In an ignition system having load capacitance means for charging and discharging to drive an ignition coil, an ignition coil drive system operable with low peak input currents comprising:

means for supplying power;

means coupled to said power supply means for generating an oscillating drive signal, the frequency of said drive signal varying directly with the magnitude of said supplied power;

a step-up transformer having a primary winding coupled to said drive signal generating means and having a secondary winding providing a transformer output signal; and means coupled between the secondary winding of said transformer and said load capacitance means for doubling the magnitude of said transformer output signal applied to said load capacitance means for charging said load capacitance means.

3. In an ignition system having load capacitance means for charging and discharging to drive an ignition coil, an ignition coil drive system operable with low peak input currents comprising:

means for supplying power;

means coupled to said power supply means for generating an oscillating drive signal, the frequency of said drive signal varying directly with the magnitude of said supplied power;

a step-up transformer having a primary winding coupled to said drive signal generating means and having a secondary winding providing a transformer output signal; and means coupled between the secondary winding of said transformer and said load capacitance means for increasing by a factor the magnitude of said transformer output signal applied to said load capacitance means for charging said load capacitance means, said magnitude increasing means including means for limiting the magnitude of current flowing through the secondary winding of said transformer.

4. In an ignition system having load capacitance means for charging and discharging to drive an ignition coil, said load capacitance means discharging to apply power to said ignition coil to produce a spark in a spark plug, an ignition coil drive system operable with low peak input currents comprising:

means for supplying power;

means coupled to said power supply means for generating an oscillating drive signal, the frequency of said drive signal varying directly with the magnitude of said supplied power;

a step-up transformer having a primary winding coupled to said drive signal generating means and having a secondary winding providing a transformer output signal;

means coupled between the secondary winding of said transformer and said load capacitance means for increasing by a factor the magnitude of said transformer output signal applied to said load capacitance means for charging said load capacitance means; and means for floating the secondary winding of said transformer so as to eliminate any D.C. path from said load capacitance means to said spark plug.

5. In an ignition system having load capacitance means for charging and discharging to drive an ignition coil, said load capacitance means discharging to apply power to said ignition coil to produce a spark in a spark plug, an ignition coil drive system operable with low peak input currents comprising:

means for supplying power;

means coupled to said power supply means for generating an oscillating drive signal, the frequency of said drive signal varying directly with the magnitude of said supplied power;

a step-up transformer having a primary winding coupled to said drive signal generating means and having a secondary winding providing a transformer output signal;

means coupled between the secondary winding of said transformer and said load capacitance means for increasing by a factor the magnitude of said transformer output signal applied to said load capacitance means for charging said load capacitance means;

means for sensing the occurrence of said spark in said spark plug to provide a signal representative thereof; and means responsive to said spark signal for inhibiting said drive signal from driving said primary winding of said transformer for a predetermined time after the occurrence of said spark.

6. An ignition system as recited in claim 5 including means responsive to said spark signal for preventing further discharge of said load capacitance means to conserve the charge thereon.

7. In an ignition system having load capacitance means for charging and discharging to drive an ignition coil, an ignition coil drive system operable with low peak input currents comprising:

means for supplying power;

means coupled to said power supply means for generating first and second complimentary pulse trains, the frequency of each of said pulse trains varying directly with the magnitude of said supplied power;

first means for switching between an open position and a closed position in response to said first pulse train;

second means for switching between an open position and a closed position in response to said second pulse train;

a step-up transformer having a primary winding and a secondary winding providing a transformer output in response to current through said primary winding, said primary winding having a center tap coupled to said power supply means and connected between a first primary winding and a second primary winding, said first primary winding conducting current in a first direction when said first switch means is closed and said second primary winding conducting current in a second direction opposite said first direction when said second switch means is closed to induce current flowing in opposite directions in said secondary winding to charge said load capacitance means;

a spark plug coupled to said ignition coil, said load capacitance means discharging to apply power to said ignition coil to produce a spark in said spark plug;

means for sensing the occurrence of a spark in said spark plug to provide a signal representative thereof; and means responsive to said spark signal for inhibiting said drive signal from driving said primary winding for a predetermined time after the occurrence of said spark.

8. An ignition system as recited in claim 7 further including means responsive to said spark signal for preventing further discharge of said load capacitance means to conserve the charge thereon.

9. In an ignition system having load capacitance means for charging and discharging to drive an ignition coil, an ignition coil drive system operable with low peak input currents comprising:

means for supplying power;

means coupled to said power supply means for generating first and second complimentary pulse trains;

first means for switching between an open position and a closed position in response to said first pulse train;

second means for switching between an open position and a closed position in response to said second pulse train;

a set-up transformer having a primary winding and a secondary winding providing a transformer output in response to current through said primary winding, said primary winding having a center tap coupled to said power supply means and connected between a first primary winding and a second primary winding, said first primary winding conducting current in a first direction when said first switch means is closed and said second primary winding conducting current in a second direction opposite said first direction when said second switch means is closed to induce current flowing in opposite directions in said secondary winding to charge said load capacitance means; and means coupled between the secondary winding of said transformer and said load capacitance means for increasing by a factor the magnitude of said transformer output signal applied to said load capacitance means for charging said load capacitance means.

10. An ignition system as recited in claim 9 further including means for delaying the rising edge of each pulse of said pulse trains so that said pulse trains are substantially complimentary.

11. An ignition system as recited in claim 9 wherein said magnitude increasing means includes means for doubling the magnitude of said transformer output signal.

12. An ignition system as recited in claim 9 wherein said magnitude increasing means includes means for limiting the magnitude of current flowing through the secondary winding of said transformer.

13. An ignition system as recited in claim 9 wherein said load capacitance means discharges to apply power to said ignition coil to produce a spark in a spark plug and further including means for floating the secondary winding of said transformer so as to eliminate any D.C. path from said load capacitance means to said spark plug.

14. An ignition system as recited in claim 9 wherein said load capacitance means discharges to apply power to said ignition coil to produce a spark in a spark plug, and further including means for sensing the occurrence of said spark in said spark plug to provide a signal representative thereof; and means responsive to said spark signal for inhibiting said drive signal from driving said primary winding of said transformer for a predetermined time after the occurrence of said spark.

15. An ignition system as recited in claim 14 including means responsive to said spark signal for preventing further discharge of said load capacitance means to conserve the charge thereon.

16. In an ignition system having an ignition coil coupled to a spark plug and load capacitance means for charging and discharging to drive said ignition coil to produce a spark in said spark plug, an ignition coil drive system comprising:

means for supplying power;

means coupled to said power supply means for generating an oscillating drive signal;

a step-up transformer having a primary winding driven by said oscillating drive signal and having a secondary winding responsive to the driving of said primary winding for providing a transformer output signal, said transformer output signal being coupled to said load capacitance means for charging said load capacitance means;

means for sensing the occurrence of a spark in said spark plug to provide a spark signal representative thereof; and means responsive to said spark signal for inhibiting said drive signal from driving said primary winding for a predetermined time after the occurrence of said spark.

17. An ignition system as recited in claim 16 further including means responsive to said spark signal for preventing further discharge of said load capacitance means to conserve the charge thereon.

18. An ignition system as recited in claim 17 and wherein said oscillator includes means for generating first and second complimentary pulse trains and said primary winding of said step-up transformer includes a center tap coupled to said power supply means and connected between a first primary winding and a second primary winding, said ignition system further including first means for switching between an open position and closed position in response to said first pulse train; and second means for switching between an open position and a closed position in response to said second pulse train, said first primary winding of said transformer conducting current in a first direction when said first switch means is closed and said second primary winding conducting current in a second direction opposite said first direction when said second switch means is closed to induce current flowing in opposite directions in said secondary winding to charge said load capacitance means.

19. An ignition system as recited in claim 18 further including means coupled between the output of said secondary winding of said transformer and said load capacitance means for increasing the magnitude of said transformer output by a factor of at least two.

20. An ignition system as recited in claim 16 further including means for floating the secondary winding of said transformer so as to eliminate any D.C. path from said load capacitance means to said spark plug.

* * * * *